US009617924B2

(12) United States Patent
Park

(10) Patent No.: US 9,617,924 B2
(45) Date of Patent: Apr. 11, 2017

(54) VALVE ASSEMBLY

(71) Applicant: Hyundai Kefico Corporation, Gunpo-si, Gyeonggi-do (KR)

(72) Inventor: Yong-Soon Park, Seongnam-si (KR)

(73) Assignee: HYUNDAI KEFICO CORPORATION, Gunpo-Si (KR)

( * ) Notice: Subject to any disclaimer, the term of this patent is extended or adjusted under 35 U.S.C. 154(b) by 194 days.

(21) Appl. No.: 14/403,125

(22) PCT Filed: Jun. 3, 2014

(86) PCT No.: PCT/KR2014/004929

§ 371 (c)(1),
(2) Date: Nov. 21, 2014

(87) PCT Pub. No.: WO2014/196782

PCT Pub. Date: Dec. 11, 2014

(65) Prior Publication Data

US 2016/0265447 A1 Sep. 15, 2016

(30) Foreign Application Priority Data

Jun. 3, 2013 (KR) ..... 10-2013-0063668

(51) Int. Cl.

| | |
|---|---|
| ***F02D 9/10*** | (2006.01) |
| ***F02D 11/10*** | (2006.01) |
| *F02D 9/02* | (2006.01) |

(52) U.S. Cl.

CPC ..... *F02D 9/1065* (2013.01); *F02D 9/02* (2013.01); *F02D 11/10* (2013.01); *F02D 11/107* (2013.01);

(Continued)

(58) Field of Classification Search

CPC . F02D 9/02; F02D 9/10; F02D 9/1065; F02D 11/10; F02D 2009/0269; F02D 2011/102

(Continued)

(56) References Cited

U.S. PATENT DOCUMENTS 3,554,045 A * 1/1971 Littmann ..... F16D 7/10 74/411
6,352,241 B1 * 3/2002 Hannewald ..... F02D 9/10 251/129.11

(Continued)

FOREIGN PATENT DOCUMENTS

CN 1847632 A 10/2006
EP 1219803 A2 7/2002

(Continued)

OTHER PUBLICATIONS

International Search Report, mailed Jul. 24, 2014 in connection with PCT International Application No. PCT/KR2014/004929, filed Jun. 3, 2014.

(Continued)

*Primary Examiner* — John Kwon
*Assistant Examiner* — Johnny H Hoang
(74) *Attorney, Agent, or Firm* — John P. White; Cooper & Dunham LLP

(57) ABSTRACT

The present invention relates to a valve assembly and, more particularly, to a valve assembly which has a simple configuration to return a valve from an open or closed position to an initially-set position when the supply of electric power to a drive motor which controls the open ratio of the valve is shut off.

19 Claims, 26 Drawing Sheets

(52) U.S. Cl.
CPC *F02D 2009/0269* (2013.01); *F02D 2011/102* (2013.01)

(58) Field of Classification Search
USPC ..... 123/337, 361, 367, 376, 396, 398–400, 123/403
See application file for complete search history.

(56) References Cited

U.S. PATENT DOCUMENTS

| | | | | |
|---|---|---|---|---|
| 7,210,451 | B2 * | 5/2007 | Ikeda | F02D 11/106 123/337 |
| 7,216,625 | B2 * | 5/2007 | Ikeda | F02D 11/10 123/399 |
| 7,302,931 | B2 * | 12/2007 | Saito | F02D 9/107 123/396 |
| 2005/0028871 | A1 * | 2/2005 | Kurita | F02D 9/105 137/554 |
| 2007/0056559 | A1 * | 3/2007 | Kondo | F02D 9/1065 123/399 |
| 2007/0163541 | A1 * | 7/2007 | Schweinfurth | F02D 11/107 123/396 |
| 2013/0068978 | A1 * | 3/2013 | Hiranuma | F02D 11/106 251/129.12 |
| 2013/0305854 | A1 * | 11/2013 | Wildforster | E05F 15/611 74/89 |
| 2015/0159751 | A1 * | 6/2015 | Pritchard | B60K 17/3467 475/150 |

FOREIGN PATENT DOCUMENTS

| | | | |
|---|---|---|---|
| EP | 1731736 | A1 | 12/2006 |
| JP | 2006-291912 | A | 10/2006 |
| JP | 2008-038876 | A | 2/2008 |
| JP | 2009-162073 | A | 7/2009 |
| KR | 2003-0050446 | A | 6/2003 |
| KR | 10-0550282 | B1 | 2/2006 |
| KR | 10-1147003 | B1 | 5/2012 |
| KR | 1998-083373 | A | 12/2012 |

OTHER PUBLICATIONS

Written Opinion of the International Searching Authority, mailed Jul. 24, 2014 in connection with PCT International Application No. PCT/KR2014/004929, filed Jun. 3, 2014.

Jul. 15, 2016 German official action (including English translation) in connection with corresponding German patent application No. 112014000111.2.

* cited by examiner

VALVE ASSEMBLY

CROSS-REFERENCE TO RELATED APPLICATIONS

This application is a §371 national stage of PCT International Application No. PCT/KR2014/004929, filed Jun. 3, 2014, claiming priority of Korean Patent Application No. 10-2013-0063668, filed Jun. 3, 2013, the contents of each of which are hereby incorporated by reference in their entirety.

TECHNICAL FIELD

The present invention relates generally to a valve assembly and, more particularly, to a valve assembly which has a simple configuration to return a valve from an open or closed position to an initially-set position when the supply of electric power to a drive motor which controls the open ratio of the valve is shut off.

This application claims priority to Korean Patent Application No. 10-2013-0063668, filed on Jun. 3, 2013, the entire contents of which is incorporated herein by reference.

BACKGROUND ART

A valve assembly which opens and closes a passageway through which fluid flows is usually used in a variety of systems within a vehicle. The valve assembly is generally actuated by an electronic actuator. The performance of the valve assembly is determined by its ability to accurately and rapidly open and close a passageway. In particular, control over the open ratio of a throttle valve used in a vehicle is an important factor since the open ratio of the throttle valve is influential in determining the power of an engine. The open ratio of the valve assembly is measured and controlled by a sensor. When the supply of electric power is shut off, there is a danger in that the open ratio of the valve assembly does not return to the initial position. This danger is significant especially for a throttle valve used in a vehicle.

A throttle device applied to an internal combustion engine such as a vehicular engine is a device which is mechanically connected to an accelerator pedal of a vehicle. When a driver steps on the accelerator pedal while the vehicle is traveling, the throttle device operates a throttle valve, thereby supplying as much air as required for accelerating the vehicle to the engine.

Among such throttle devices, there is a throttle device which is not provided with a separate bypass passageway on an intake passage. This throttle device is configured to automatically open a throttle valve to a preset angle to provide a minimum amount of air such that the engine does not stop, in response to a signal from an engine control system when the vehicle is not accelerated during traveling or when the vehicle is idling such as during startup.

A throttle device of the related art has a semi-electronic configuration in which a throttle valve is automatically opened under the control of an engine control system in an idling state and is opened in response to force with which a driver steps on the accelerator pedal being mechanically delivered to a throttle valve shaft.

In addition, a throttle position sensor, which generates an electrical signal by detecting the angle of rotation of the throttle valve, is provided at a preset position inside the throttle body. A motor which is disposed at one side of the throttle body serves to open the throttle valve such that a minimum amount of air required for the operation of the engine is introduced. A connector is provided at a preset position outside the throttle body.

In this throttle device of the related art, the throttle valve is opened when the motor operates in response to an electrical signal from the engine control system in the idling state. However, in the acceleration state, the throttle valve shaft and the throttle valve rotate in response to the rotation of a pulley connected to the accelerator pedal, thereby degrading the performance and drivability of a vehicle.

In addition, in the throttle device of the related art, the throttle position sensor which generates a signal by detecting the angle of the throttle valve and the connector are mounted on the throttle body. The pulley, which rotates in cooperation with the accelerator pedal, and the return spring are disposed outside the throttle body. Thus, there are problems in that assembly performance is very poor and the size of an article increases.

Furthermore, in the throttle device of the related art, the minimum angle of opening of the throttle valve is pre-calculated in order to adjust the minimum amount of air required for the idling state and then is mechanically fixed by, for example, welding, in a fabrication process. In this case, when the amount of air is set, the amount of air changes significantly due to errors in the machining and assembly of parts, thereby making it difficult to accurately set the minimum amount of air, which is problematic.

A prior art related to this is disclosed in Korean Laid-Open Patent Publication No. 1998-0083373 (published Dec. 5, 1998, titled: "ELECTRICALLY CONTROLLED DEVICE FOR OPENING AND CLOSING THROTTLE").

DISCLOSURE

Technical Problem

Accordingly, the present invention has been made keeping in mind the above problems occurring in the prior art, and an object of the present invention is to provide a valve assembly which has a returning means inside a segment gear which can deploy a plate to an open or closed position such that the plate can return to an initially-set position when the supply of power to a drive motor which rotates the segment gear is shut off in the state in which the plate is deployed to the open or closed position.

Another object of the present invention is to provide a valve assembly in which the returning means can return the plate to the initially-set position using a simple configuration, i.e. a pair of elastic members consisting of a first coil spring and a second coil spring.

A further object of the present invention is to provide a limiting means for limiting the angle of rotation of the segment gear in application of an electronic throttle valve in order to prevent the plate from being deployed to the closed position within an intake port of a throttle body, thereby preventing an electronic throttle valve assembly from being damaged or the endurance thereof from degrading.

Technical Solution

In order to accomplish the above object, the present invention provides a valve assembly which controls an open ratio of a throttle valve using a drive motor operated by an engine control unit depending on an open ratio of an accelerator pedal. The valve assembly includes: a throttle body which has defined therein an intake port which penetrates through the throttle body from a front end to a rear end; a shaft disposed in the throttle body, the shaft penetrating through the throttle body from one side surface to the opposite side surface; bearings disposed on each of end portions of the shaft; a plate disposed on a central portion of the shaft to open or close the intake port in response to a rotation of the shaft; a segment gear disposed on one side of the throttle body and coupled to one end portion of the shaft; an intermediate gear which transmits driving force of a drive motor provided on the throttle body to the segment gear; a cover which closes the intermediate gear from the outside; and a returning means including a pair of elastic members which are provided on the segment gear, wherein, when the driving force from the drive motor that has been acting on the intermediate gear is shut off, the segment gear is rotated by a different one of the pair of elastic members according to whether the plate is deployed to an open or closed position, thereby returning the plate to an initially-set position.

The segment gear may include: a flange portion disposed on an upper portion of the segment gear, with a gear portion being formed on part of a circumference of the flange portion; a first fixing recess defined by a sunken portion in the circumference of the flange portion; a tubular outer case extending downward from the flange portion; a tubular inner case extending downward from the flange portion, the inner case being spaced apart from an inner side surface of the outer case to form a receptacle, and an inner diameter of the inner case being smaller than that of the outer case; a second fixing recess extending upward from a lower end of the outer case, the second fixing recess opening part of a side surface portion of the outer case; and a third fixing recess extending upward from a lower end of the outer case that opposes the second fixing recess, the third fixing recess opening part of the side surface portion of the outer case.

The first fixing recess may be formed close to one of either end portions of the gear portion disposed on the circumference of the flange portion.

The gear portion disposed on the flange portion may be positioned between the second and third fixing recesses.

A separation-preventing recess may be further provided on an upper or lower portion of the second fixing recess, the separation-preventing recess extending in a direction parallel to a direction in which the segment gear rotates.

The separation-preventing recess may extend from an upper or lower portion of the second fixing recess in a direction opposite to the gear portion disposed on the flange portion.

The second fixing recess may be positioned below the first fixing recess.

Here, the returning means may include: a first coil spring disposed such that the first coil spring surrounds an outer circumference of the outer case, one end portion of the first coil spring being fixed to the first fixing recess, and the other end portion of the first coil spring being fixed to a fixing slot which is formed on one side surface of the throttle body; and a second coil spring disposed in the receptacle defined between the outer case and the inner case, one end portion of the second coil spring being fixed to the second fixing recess, and the other end portion of the second coil spring being fixed to the third fixing recess.

An inner surface of the first coil spring may be spaced apart from an outer circumference of the outer case, thereby defining a space portion.

When the plate is in the open position, the plate may be returned to the initially-set position by elastic restoring force of the first coil spring. When the plate is in the closed position, the plate may be returned to the initially-set position by elastic restoring force of the second coil spring.

The other end portion of the first coil spring may be disposed at a position ranging from 90 to 110° in a clockwise direction with respect to a bottom of a vertical line that passes through one end portion of the first coil spring, the other end portion of the first coil spring being bent outward from the first coil spring.

One end portion of the second coil spring may be bent to extend outward from the second coil spring, and the other end portion of the second coil spring is formed at a position ranging from 360 to 450° in a clockwise direction with respect to one end portion of the second coil spring and is bent to extend outward from the second coil spring.

One end portion of the second coil spring may be fixed to the second fixing recess, and the other end portion of the second coil spring may be fixed to the third fixed recess by being turned counterclockwise such that the second coil spring is elastically deformed in a winding direction.

One end of the second coil spring may be disposed in the separation-preventing recess which is formed in the upper or lower portion of the second fixing recess.

Here, a lug portion may be provided on a portion of one side surface of the throttle body to which the segment gear is coupled, the lug portion protruding from one side surface of the throttle body at a position ranging from 180 to 270° in a clockwise direction from the fixing slot with respect to one end portion of the shaft which protrudes toward one side surface of the throttle body.

The segment gear may be rotated clockwise such that the first coil spring is elastically deformed in a winding direction after the other end portion of the first coil spring is fixed to the fixing slot, such that the other end portion of the second coil spring is fixedly held by the lug portion.

The second coil spring may be fixedly held by the lug portion such that the other end portion of the second coil spring is positioned between the fixing slot and the lug portion.

The first coil spring may apply a torque that causes the segment gear to rotate counterclockwise when the plate is in the open or closed position. The second coil spring may be separated from the lug portion without applying an elasticity-induced torque to the segment gear when the plate is in the open position, and may be held by the lug portion and applies a torque that causes the segment gear to rotate clockwise when the plate is in the closed position.

The elastic force of the second coil spring may be greater than the elastic force of the first coil spring.

The valve assembly may further include a limiting means which protrudes from one side surface of the throttle body so as to be close to the circumference of the segment gear, thereby limiting the angle of rotation of the segment gear.

The limiting means may include a support protruding from one side surface of the throttle body and a stopper disposed on the upper portion of the support such that the stopper can be supported on one end portion of the gear portion which is disposed on the circumference of the flange portion.

The stopper may penetrate through the upper portion of the support. The distance between the support and the distal end portion of the gear portion which is to come into contact with the support may be adjusted by rotating the stopper.

The valve assembly may be an electronic throttle valve.

Advantageous Effects

According to the foregoing Technical Solution, the returning means according to the present invention are provided inside the segment gear which can deploy the plate to an open or closed position. With this configuration, when the supply of power to the drive motor which rotates the segment gear is shut off in the state in which the plate is deployed to the open or closed position, the plate can return to an initially-set position.

In addition, there is an advantageous effect in that the returning means can return the plate to the initially-set position using a simple configuration, i.e. the pair of elastic members consisting of the first coil spring and the second coil spring.

Furthermore, there is another advantageous effect in that the limiting means for limiting the angle of rotation of the segment gear in application of the electronic throttle valve in order to prevent the plate from being deployed to the closed position within an intake port of the throttle body, thereby preventing the electronic throttle valve assembly from being damaged or the endurance thereof from degrading.

DESCRIPTION OF THE REFERENCE NUMERALS IN THE DRAWINGS

Figure 1:
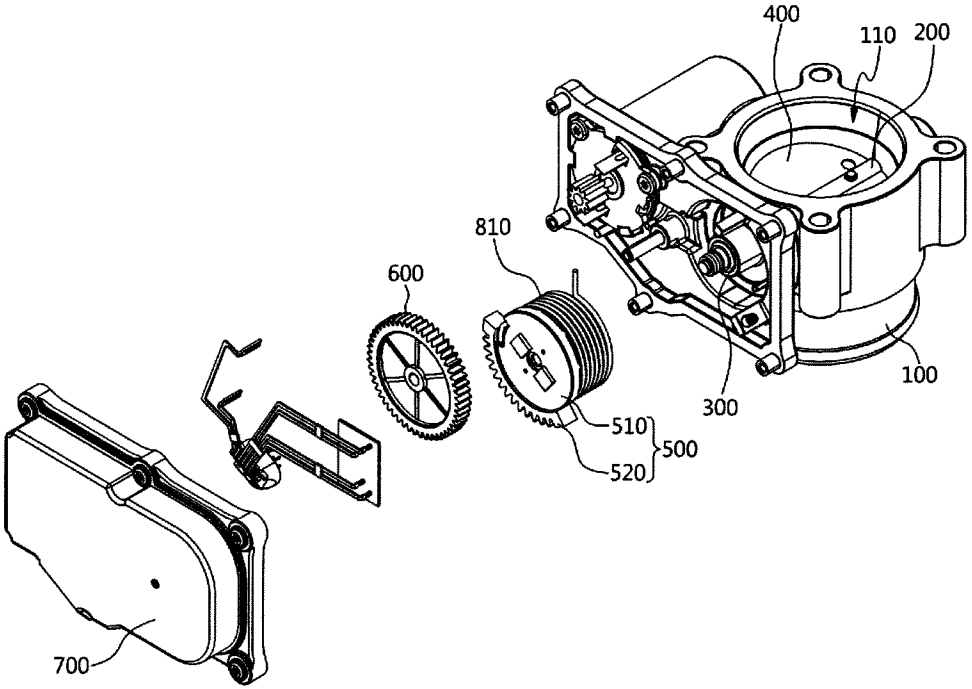
FIG. 1 is an exploded perspective view showing a valve assembly according to an embodiment of the present invention.

1: valve assembly
100: throttle body
110: intake port
120: fixing slot
130: lug portion
200: shaft
300: bearing
400: plate
500: segment gear
510: flange portion
520: gear portion
530: first fixing recess
540: second fixing recess
550: third fixing recess
560: outer case
570: inner case
580: separation-preventing recess
590: space portion
600: intermediate gear
700: cover
810: first coil spring
820: second coil spring
900: limiting means
910: support
920: stopper

Mode For Invention

The present invention will be described hereinafter with reference to the accompanying drawings. In the following description of the present invention, detailed descriptions of known functions and components incorporated herein will be omitted when they may make the subject matter of the present invention unclear. Embodiments of the present invention are provided in order to more fully convey the scope of the invention to a skilled in the art. Therefore, the shapes and dimensions of components in the drawings may be exaggerated for clarity.

Among throttle devices of a valve assembly 1 according to the present invention, a throttle device such as a plate 400, which is not provided with a separate bypass passageway on an intake passage, is configured to automatically open a throttle valve to a preset angle to provide a minimum amount of air such that the engine does not stop, in response to a signal from an engine control system when a vehicle is not accelerated during traveling or when the vehicle is idling such as during startup.

FIG. 1 is an exploded perspective view showing the valve assembly 1 according to an embodiment of the present invention. A description will be give below of the valve assembly 1 according to the invention with reference to FIG. 1. The valve assembly 1 controls the open ratio of a valve using a drive motor M operated by an engine control unit depending on the open ratio of an accelerator pedal. The valve assembly 1 includes a body 100 which has defined therein an intake port 110 which penetrates through the body from the front end to the rear end; a shaft 200 disposed in the body 100, the shaft 200 penetrating through the body from one side surface to the opposite side surface; bearings 300 disposed on one and the other end portions of the shaft 200; the plate 400 disposed on a central portion of the shaft 200 to open or close the intake port 110 in response to the rotation of the shaft 200; a segment gear 500 disposed on one side of the body 100 and coupled to one end portion of the shaft 200; an intermediate gear 600 which transmits driving force of a drive motor provided on the body 100 to the segment gear 500; a cover 700 which closes the intermediate gear 600 from the outside; and a returning means including a pair of elastic members which are provided on the segment gear 500. When the driving force from the drive motor that has been acting on the intermediate gear is shut off, the segment gear 500 is rotated by a different one of the pair of elastic members according to whether the plate 400 is deployed to an open or closed position, thereby returning the plate 400 to the initially-set position. Here, the valve assembly according to the present invention can be applied to a throttle valve of a vehicle, and the body 100 can be a throttle body that is used in the throttle valve of the vehicle.

A typical valve assembly is configured such that its open ratio is measured and controlled by an electronic sensor, and operates basically using power from the drive motor. The valve assembly according to an embodiment of the present invention is configured such that components are mechanically connected together, and thus can perform the operation of returning the valve to the initially-set position even if the supply of electric power is shut off unexpectedly. This is a feature that can be applied especially to a throttle valve of a vehicle, and forms an invention that can improve the safety of the vehicle.

The shaft 200 is disposed to penetrate through the intake port 110, in which the bearings 300 are provided on one and the other end portions of the shaft, and the plate 400 is provided on the central portion of the shaft. The plate 400 can be deployed to open or close the intake port 110 in response to the rotation of the shaft 200.

One end portion of the shaft 200 is coupled with the lower end portion of the segment gear 500 which is provided on one side surface of the body 100. The shaft 200 rotates in response to the rotation of the segment gear 500.

The drive shaft of the drive motor rotates in response to electric power applied thereto, and a rotational driving force of the drive motor can be transmitted to the segment gear 500 through the intermediate gear 600 which is disposed between the drive shaft of the drive motor and the segment gear 500.

The drive motor can be controlled by the engine control unit. The plate 400 is fabricated into a circular shape corresponding to the inner diameter of the intake port 110 such that the plate can be deployed to open or close the intake port 110 depending on the angle of rotation. The plate 400 can be fabricated into a variety of shapes in addition to the circular shape depending on the design.

The technical principle of the present invention provides the returning means with which the plate 400 can return to the initially-set position when the plate 400 is deployed to the open position or when the transmission of driving force from the drive motor is shut off in the state in which the plate 400 is deployed to the closed position. This structure can be applied to an electromagnetic throttle valve which is used in a vehicle. Since the electromagnetic throttle valve is controlled through the supply of electric power, the structure according to the present invention can significantly improve the safety of, in particular, a vehicle and is advantageous in terms of volume reduction.

Figure 4:
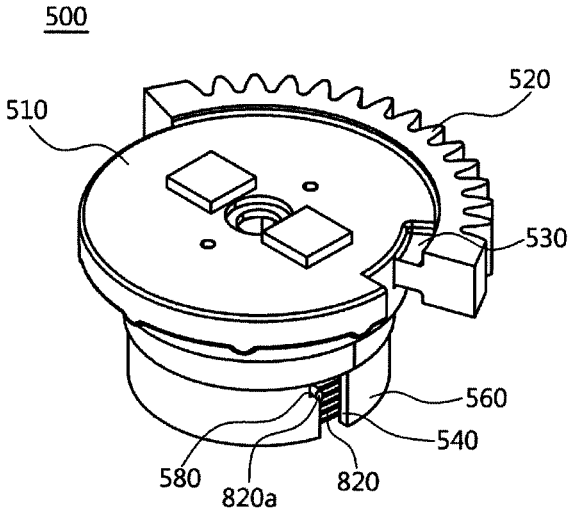
FIG. 4 is a perspective view showing a segment gear according to an embodiment of the present invention.
Figure 5A:
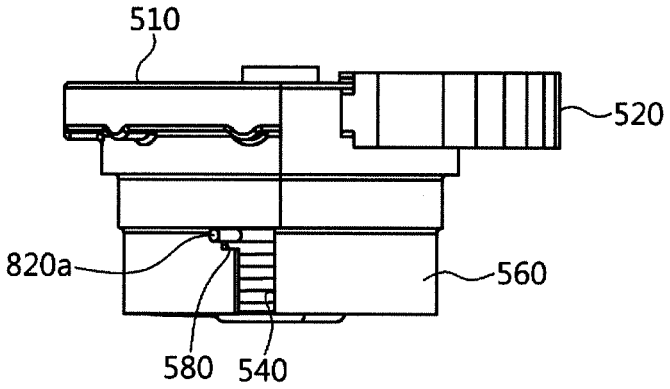
FIG. 5A to FIG. 5C are side-elevation views showing one side surface of the segment gear according to an embodiment of the present invention.
Figure 5B:
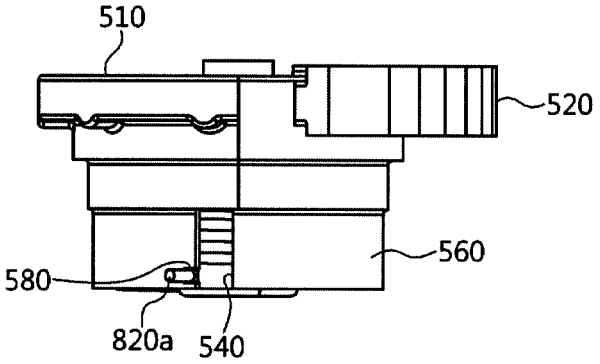
Figure 5C:
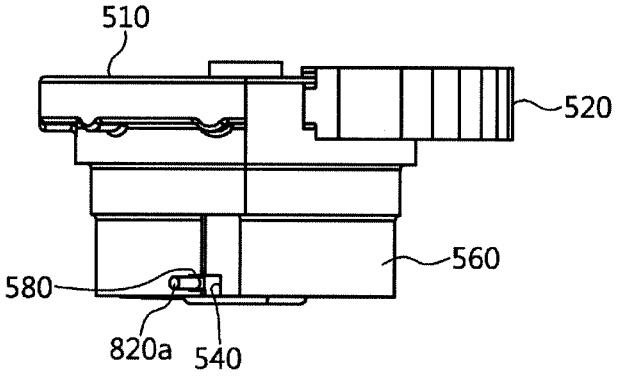
Figure 6A:
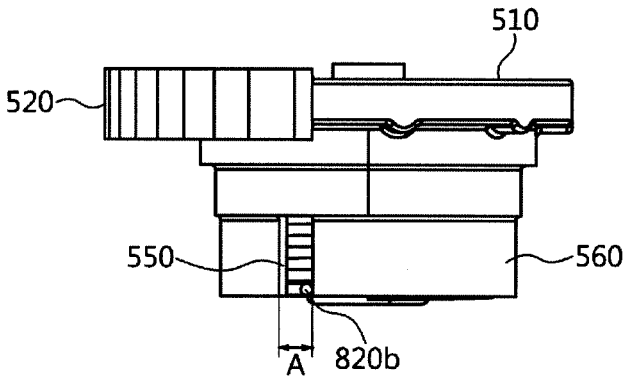
FIG. 6A and FIG. 6B are side-elevation views showing the other side surface of the segment gear according to an embodiment of the present invention.
Figure 6B:
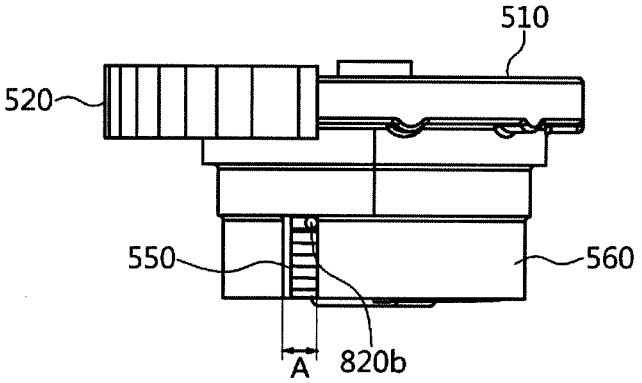
Figure 7:
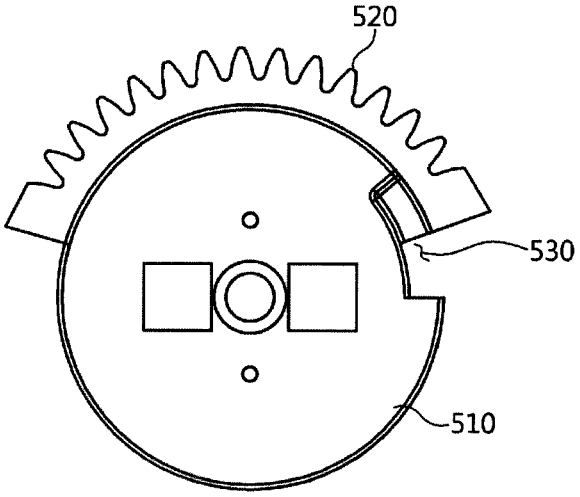
FIG. 7 is a top-plan view of the segment gear according to an embodiment of the present invention.
Figure 8:
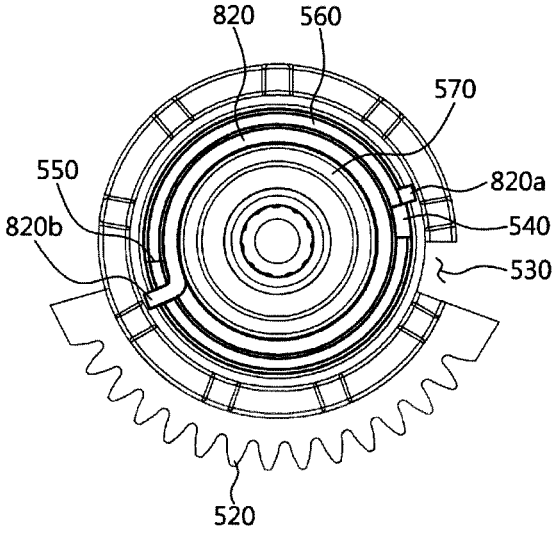
FIG. 8 is a bottom view of the segment gear according to an embodiment of the present invention.

FIG. 4 is a perspective view showing the segment gear 500 according to an embodiment of the present invention, FIG. 5A to FIG. 5C are side-elevation views showing one side surface of the segment gear 500 according to an embodiment of the present invention, FIG. 6A and FIG. 6B are side-elevation views showing the other side surface of the segment gear 500 according to an embodiment of the present invention, FIG. 7 is a top-plan view of the segment gear 500 according to an embodiment of the present invention, and FIG. 8 is a bottom view of the segment gear 500 according to an embodiment of the present invention.

Describing the segment gear 500 in greater detail with reference to FIG. 4 to FIG. 8, the segment gear 500 includes a flange portion 510 disposed on the upper portion of the segment gear 500; a gear portion 520 formed on part of the circumference of the flange portion 510; a first fixing recess 530 defined by a sunken portion in the circumference of the flange portion 510; a tubular outer case 560 extending downward from the flange portion; a tubular inner case 570 extending downward from the flange portion, the inner case 570 being spaced apart from the inner side surface of the outer case 560 to form a receptacle, and the inner diameter of the inner case 570 being smaller than that of the outer case 560; a second fixing recess 540 extending upward from the lower end of the outer case 560, the second fixing recess 540 opening part of the side surface portion of the outer case 560; and a third fixing recess 550 extending upward from the lower end of the outer case 560 that opposes the second fixing recess, the third fixing recess 550 opening part of the side surface portion of the outer case 560.

The inner case 570 is positioned inside the outer case 560 and extends downward of the flange portion 510. The outer case 560 and the inner case 570 are spaced apart from each other, thereby defining a receptacle therebetween in which a second coil spring 820 of the returning means can be received.

The gear portion 520 is the portion that meshes with the intermediate gear 600, and protrudes from the circumference of the flange portion 510. The gear portion 520 is formed on the circumference of the flange portion 510 such that it is positioned between the second fixing recess 540 and the third fixing recess 550 which are formed on the outer case 560. The second fixing recess 540 and the third fixing recess 550 are formed on the outer case 560, at positions that face each other by 180°. The second and third fixing recesses 540 and 550 extend upward from the lower end of the outer case 560, thereby penetrating through the side surfaces of the outer case 560. The first fixing recess 530 is formed on the circumference of the flange portion 510 such that it is positioned at one end portion of the gear portion 520, i.e. the upper portion of the second fixing recess 540.

Referring to FIG. 5A to FIG. 5C, the second fixing recess 540 further has a separation-preventing recess 580 which extends from the upper or lower portion of the second fixing recess 540 in the direction parallel to the direction in which the segment gear 500 rotates. In other words, the separation-preventing recess 580 can be formed on a region of the upper portion of the second fixing recess 540, as shown in FIG. 5A, or on a region of the lower portion of the second fixing recess 540, as shown in FIG. 5B. When the separation-preventing recess 580 is formed in this manner, it is possible to firmly fix one end of the second coil spring 820 and prevent the spring from being separated when the vehicle shakes or during the iterative valve-opening operation. The separation-preventing recess 580 is preferably formed on the upper portion or the lower portion of the second fixing recess 540 to fix the second coil spring 820. In this configuration, one end of the second coil spring is fixed due to the structure of the recess or the elasticity of the spring. When the separation-preventing recess 580 is formed on the upper end of the second fixing recess 540, it is effective in preventing the second coil spring 820 from being separated.

In addition, when the separation-preventing recess 580 is formed on the lower end of the second fixing recess 540, the resultant structure is advantageous to fix the second coil spring 820 such that the other end thereof does not move upwards or downwards. Specifically, as shown in FIG. 5B, the separation-preventing recess 580 is formed on the lower portion of the second fixing recess 540 and one end portion 820*a* of the second coil spring 820 is fixedly fitted into the separation-preventing recess 580. Then, as shown in FIG. 6B, the other end portion 820*b* of the second coil spring 820 is disposed on the upper portion of the third fixing recess 550. This can consequently prevent the other end portion 820*b* from moving upwards or downwards and prevent the turns of the second coil spring 820 from rubbing against each other. In this case, as shown in FIG. 5B, the separation-preventing recess 580 is preferably spaced apart a predetermined height from the lower surface of the outer case 560, thereby fixing one end portion 820*a* of the second coil spring 820 from the top and bottom. That is, according to this structure, the flange protruding from the lower portion of the outer case 560 adjoins to and supports one end portion of the second coil spring, thereby preventing the second coil spring from being separated from the outer case 560.

In addition, as shown in FIG. 5C, the separation-preventing recess 580 can be formed at a position that is spaced apart at a predetermined height from the bottom of the outer case 560, and the second fixing recess 540 can be machined such that it is not opened beyond the portion where the separation-preventing recess 580 is formed. In this case, it is sufficient to machine the second fixing recess 540 to the portion where the separation-preventing recess 580 without having to machine and open the second fixing recess 540 from the upper end to the lower end of the outer case. This structure can has an advantageous effect in terms of reduced processing time or a simplified fabrication process, and can effectively prevent the second coil spring from being separated. That is, in the structure in which the separation-preventing recess 580 is formed on the lower portion of the outer case 560 to fix the second coil spring, the second fixing recess 540 can be machined to a size required for fitting one end portion 820*a* of the second coil spring into the separation-preventing recess 580. In this aspect, the advantage of this structure differs from that of the structure in which the separation-preventing recess 580 is formed on the upper portion of the outer case 560.

According to the present invention, the separation-preventing recess 580 preferably extends in the direction opposite to the gear portion 520, which is formed on the circumference of the flange portion 510, between the second and third fixing recesses 540 and 550.

A description will be given below of the embodiment shown in FIG. 5A in which the separation-preventing recess 580 is formed on the upper portion of the second fixing recess 550 for the sake of explanation. It is therefore to be understood that the modified embodiments shown in FIG. 5B and FIG. 5C can operate based on the same technical principle within the range that a person skilled in the art can expect.

Figure 2:
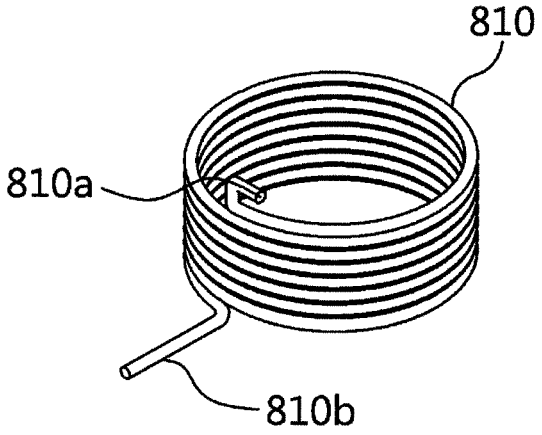
FIG. 2 is a perspective view showing a first coil spring according to an embodiment of the present invention.
Figure 3:
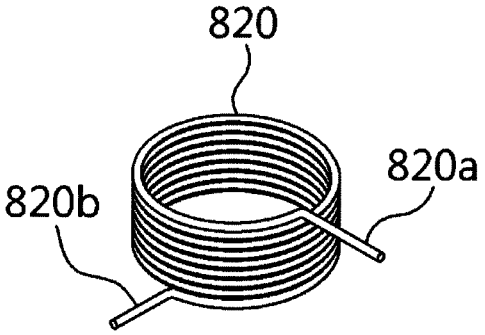
FIG. 3 is a perspective view showing a second coil spring according to an embodiment of the present invention.

FIG. 2 is a perspective view showing a first coil spring 810 according to an embodiment of the present invention, and FIG. 3 is a perspective view showing a second coil spring 820 according to an embodiment of the present invention. The returning means includes the first coil spring 810 and the second coil spring 820. The first coil spring 810 is disposed such that it surrounds the outer circumference of the outer case 560. One end portion 810*a* of the first coil spring is fixed to the first fixing recess 530, and the other end portion 810*b* of the first coil spring is fixed to a fixing slot 120 which is formed on one side surface of the body 100. The second coil spring 820 is disposed in the receptacle defined between the outer case 560 and the inner case 570. One end portion 820*a* of the second coil spring is fixed to the second fixing recess 540, and the other end portion 820*b* of the second coil spring is fixed to the third fixing recess 550.

The first and second coil springs 810 and 820 are provided on the segment gear 500 such that the coil geometries thereof are in the opposite direction. Accordingly, when the plate 400 is deployed to the open position, the plate 400 is returned to the initially-set position by the elastic restoring force of the first coil spring. When the plate 400 is deployed to the closed position, the plate 400 is returned to the initially-set position by the elastic restoring force of the second coil spring 820.

The other end portion 810*b* of the first coil spring 810 is bent outward from the first coil spring 810.

One end portion of the first coil spring 810 is fixed to the first fixing recess 530. According to the present invention, one end portion 810*a* of the first coil spring 810 is bent into the shape of a hook, which is fixedly held by the first fixing recess 530. Specifically, the first coil spring 810 is coupled to the outer case 560 such that it surrounds the outer circumference of the outer case 560, and then one hook-shaped end portion 810*a* is fixedly held by the first fixing recess 530.

In the second coil spring 820, one end portion 820*a* is bent to extend outward from the second coil spring 820. The other end portion 820*b* of the second coil spring 820 is formed at the position ranging from 360 to 450° in the clockwise direction with respect to one end portion 820*a* of the second coil spring 820, and is bent to extend outward from the second coil spring 820. Accordingly, when the second coil spring 820 is fitted into the receptacle between the outer and inner cases 560 and 570, the coil spring 820 is coupled with the receptacle such that one end portion 820*a* and the other end portion 820*b* of the second coil spring 820 protrude outward beyond the outer case 560 through the second fixing recess 540 and the third fixing recess 550.

Figure 9A:
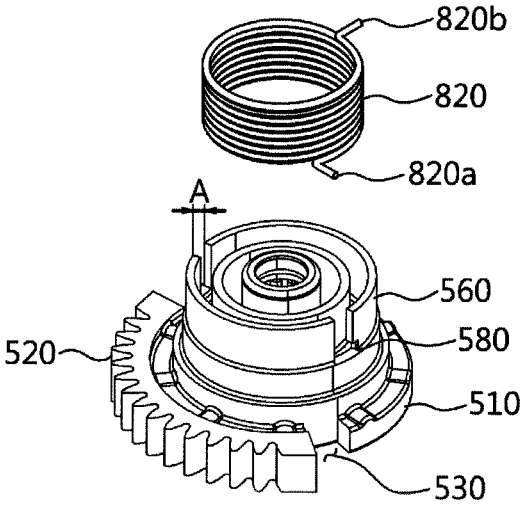
FIG. 9A to FIG. 9D are views showing the state in which the second coil spring is mounted on the segment gear.
Figure 9B:
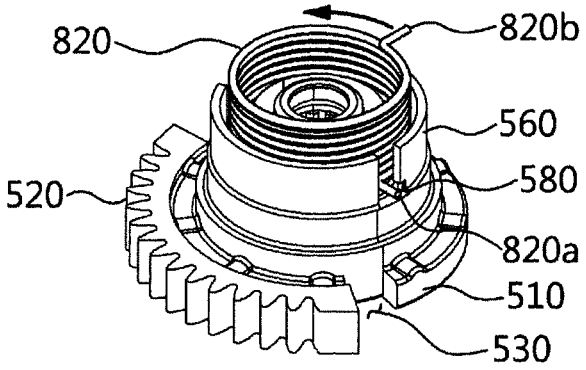
Figure 9C:
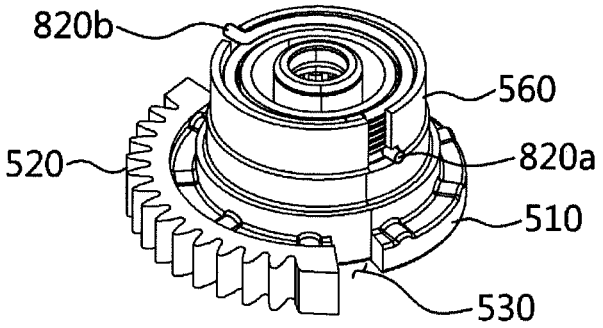

FIG. 9A to FIG. 9D are views showing the state in which the second coil spring 820 is mounted on the segment gear 500. The second coil spring 820 is mounted in the receptacle as follows: The second coil spring 820 is pushed inwards with one end portion 820*a* thereof being fitted into the second fixing recess 540 (FIG. 9A). When the other end portion 8206 of the second coil spring 820 is held by the lower end of the outer case 560, the other end portion 820*b* of the second coil spring 820 is grasped and turned counterclockwise such that the second coil spring 820 is elastically deformed in the winding direction (FIG. 9B). Then, the other end portion 820*b* of the second coil spring 820 is fixedly fitted into the third fixing recess 550 which is positioned opposite the second fixing recess 540 (FIG. 9C).

Then, due to the bent shapes, one end portion 520*a* and the other end portion 520*b* of the second coil spring 820 protrude outward beyond the outer case 560 within the second fixing recess 540 and the third fixing recess 550. In particular, one end portion 520*a* of the second coil spring 820 is positioned within the separation-preventing recess 580, which is formed on the upper or lower portion of the second fixing recess 540, thereby preventing the second coil spring 820 from being separated from the receptacle.

The other end portion 520*b* of the second coil spring 820 is disposed within the third fixing recess 550 such that it can move the width A of the third fixing recess 550. The width A of the third fixing recess 550 refers to the length corresponding to the direction perpendicular to the rotation axis on which the segment gear 500 rotates. The width A of the third fixing recess 550 corresponds to the size of reference numeral A shown in FIG. 6B and FIG. 9A. According to the present invention, the width A of the third fixing recess 550 determines the angle of rotation of the short return operation of returning to the initially-set position from the closed position.

Figure 9D:
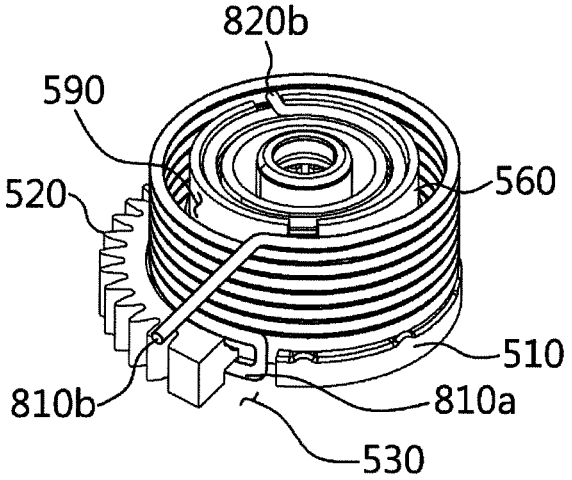

FIG. 9D is a view showing the state in which the first coil spring 80 is fitted around the outer case 560. The space separating the first coil spring 810 from the outer case 560 indicates a space portion 590 according to the present invention. A lug portion 130 which is formed on the body 100 will be positioned later inside the space portion 590.

Figure 10A:
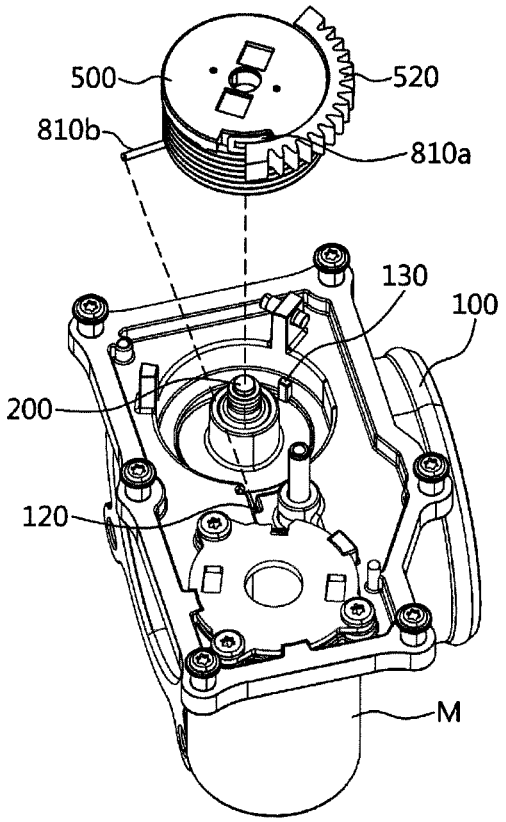
FIG. 10A to FIG. 10C are views showing the stare in which the segment gear is mounted on the throttle body.
Figure 10B:
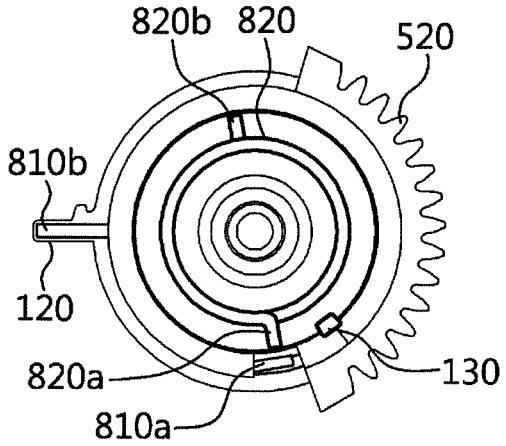
Figure 10C:
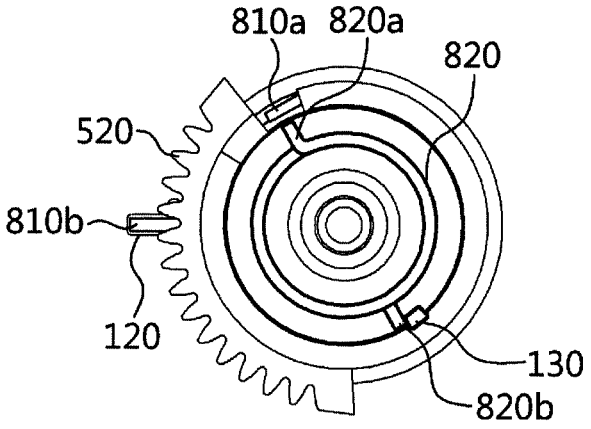
Figure 11A:
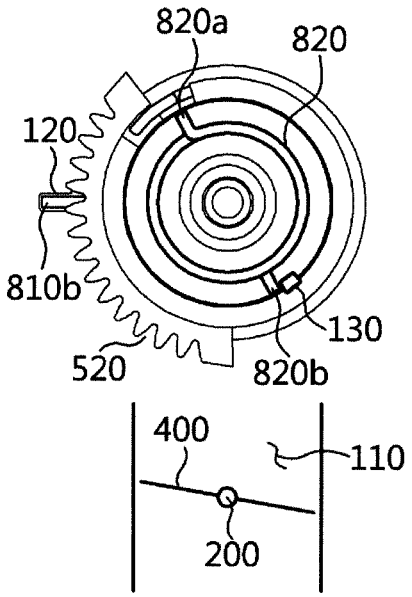
FIG. 11A to FIG. 11E are views showing a long return operation of returning the plate from an open position to an initially-set position.
Figure 11B:
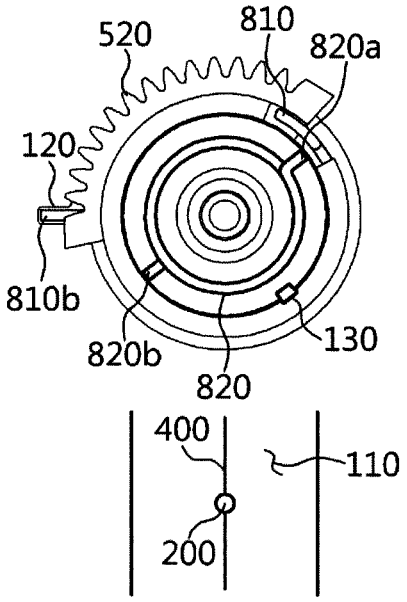
Figure 11C:
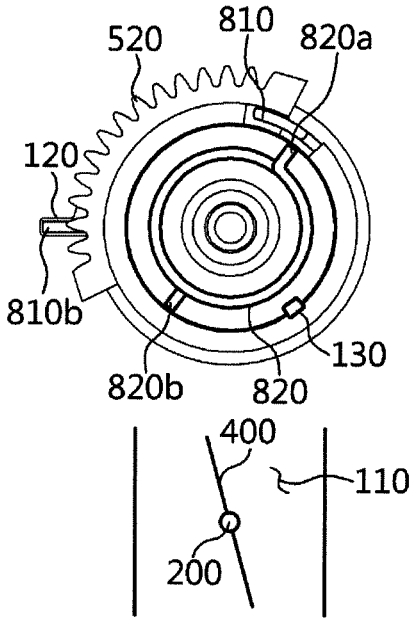
Figure 11D:
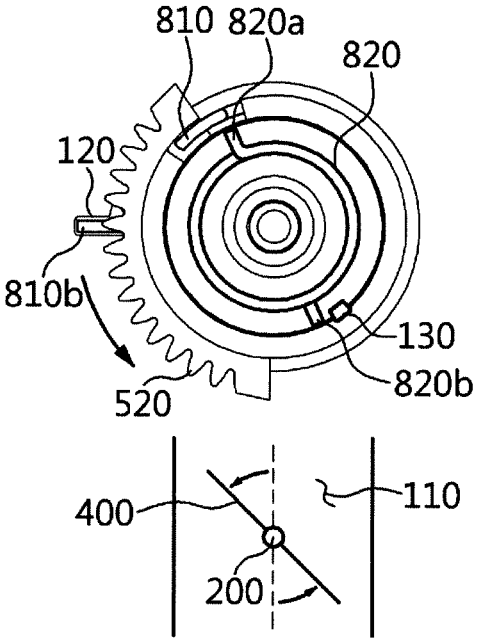
Figure 11E:
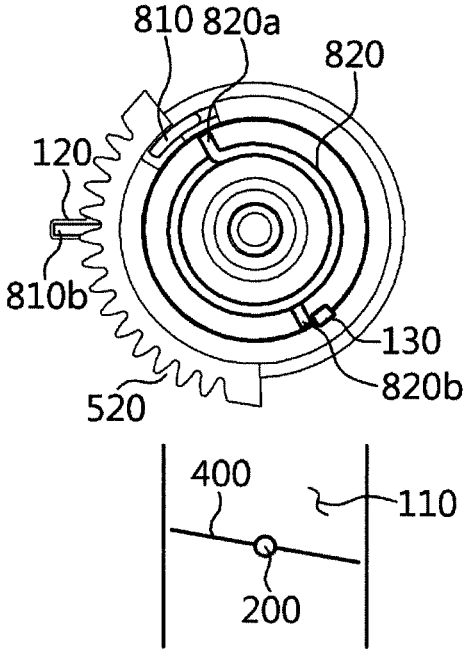

FIG. 10A to FIG. 10C are views showing the state in which the segment gear is mounted on the throttle body.

After the first and second coil springs 810 and 820 are coupled to the segment gears 500 in the above-mentioned method, the segment gear 500 is coupled to the body 100.

First, the other end portion 810*b* of the first coil spring 810 positioned below the segment gear 500 is fixedly fitted into the fixing slot 120 which is formed on one side surface of the body 100. Here, one end portion of the shaft is fitted into and coupled to the lower central portion of the segment gear 500.

The lug portion 130 is provided on the portion of one side surface of the body 100 to which the segment gear 500 is coupled. The lug portion 130 protrudes from one side surface of the body 100 at a position ranging from 180 to 270° in the clockwise direction from the fixing slot 120 with respect to one end portion of the shaft 200 which protrudes toward one side surface of the body 100. The angle between the fixing slot 120 and the lug portion 130 can be changed depending on the design of the valve assembly 1.

After the other end portion 810*b* of the first coil spring 810 is fixed to the fixing slot 120, the segment gear 500 is rotated clockwise and coupled to the body such that the other end portion 820*b* of the second coil spring 820, which protrudes outward beyond the outer case 560, is fixedly held by the lug portion 130.

Since the other end portion of the second coil spring 820 must be fixedly held by the lug portion 130, when the segment gear 500 is coupled with one side surface of the body 100, the lug portion 130 is positioned within the space portion 590 between the first coil spring 810 and the outer case 560.

Here, the other end portion 820*b* of the second coil spring 820 is positioned between the fixing slot 120 and the lug portion 130 and closely adjoins to the lug portion 130. The position of the segment gear 500 and the amount of opening or open ratio of the plate 400 at this time become the initially-set position of the plate 400.

In addition, the first coil spring 810 is subjected to torque that tends to rotate the segment gear 500 counterclockwise since the segment gear 500 is rotated in the range from 180 to 270° in the coupling process of the second coil spring 820 (FIG. 10B and FIG. 10C). However, since the elastic force of the second coil spring 820 is greater than the first coil spring 810 according to the technical principle of the present invention, the torque of the second coil spring 820 held by the lug portion 130 is greater and thus the segment gear 500 can maintain the stationary state or the initially-set position.

Thus, when the plate 400 is deployed to an open or closed position, the first coil spring 810 continues to apply counterclockwise torque to the segment gear 500. When the plate 400 is deployed to the open position, the second coil spring 820 does not apply elasticity-induced torque to the segment gear 500 since the other end portion of the second coil spring 820 is spaced apart from the lug portion 130 and is in close contact with the other side of the third fixing recess 550 (the portion of both leading end portions of the third fixing recess that is furthest away from the gear portion formed on the flange). When the plate 400 is deployed to the closed position past the initially-set position, the other end portion 820*b* of the second coil spring 820 is held by the lug portion 130, and the second coil spring 820 applies elasticity-induced torque to the segment gear 500 in the clockwise direction while moving toward one side of the third fixing recess 550 within the third fixing recess 550.

Here, the width A of the third fixing recess 550 is set such that the other end 820*b* of the second coil spring 820 is seated on one side of the third fixing recess 550 within the third fixing recess 550 when the plate 400 is deployed to the closed position, whereby the plate 400 can be prevented from being excessively opened.

Descriptions will be given below of the long return operation and the short return operation in which the plate 400 returns to the initially-set position from the open or closed position in the valve assembly having the above-described configuration.

FIG. 11A to FIG. 11E are views showing the long return operation of returning the plate 400 from the open position to the initially-set position. When the drive motor rotates clockwise, the intermediate gear 600 rotates counterclockwise, and the segment gear 500 meshed with the intermediate gear rotates clockwise, i.e. in the same direction as the drive motor. In response to the clockwise rotation of the segment gear 500, the plate 400 provided on the shaft 200 rotates clockwise to open the intake port 110. Here, the state in which the plate 400 is perpendicular to the lengthwise direction of the intake port 110, i.e. parallel to the direction of an air flow within the intake port 110, is referred to as the open position.

In this open position, the first coil spring 810 is elastically deformed in the direction of being further wound, thereby applying counterclockwise torque to the segment gear 500. In addition, in the second coil spring 820, one end portion 820*a* thereof is in close contact with the separation-preventing recess 580 while applying torque in the direction opposite the position of the gear portion, and the other end portion 820*b* thereof is spaced apart from the lug portion 130 and thus is subjected to no further elastic deformation. The other end portion 820*b* is in close contact with the other side of the third fixing recess 550 within the third fixing recess 550. In this state, the second coil spring does not apply any torque to the segment gear 500.

In this state, when the supply of power to the drive motor is shut off and thus the external force acting on the segment gear 500 is removed, the segment gear 500 rotates counterclockwise due to the restoring force of the first coil spring 810. The other end portion 820*b* of the second coil spring 820 is held by the lug portion 130 to stop the segment gear 500 rotating, whereby the long return operation of returning the plate 400 to the initially-set position is completed.

Here, since the elastic force of the second coil spring 820 held by the lug portion 130 is greater than the elastic force of the first coil spring 810, the segment 500 is not rotated further in the counterclockwise direction by the first coil spring 810, whereby the plate 400 stays in the initially-set position.

Figure 12A:
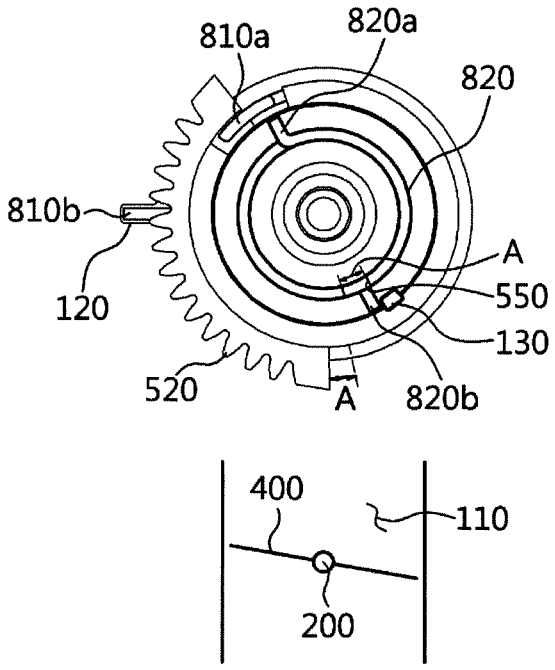
FIG. 12A and FIG. 12B are views showing a short return operation of returning the plate from a closed position to an initially-set position.
Figure 12B:
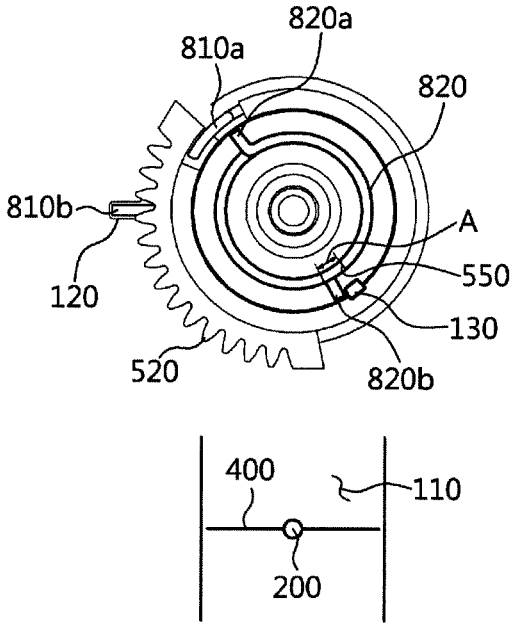

FIG. 12A and FIG. 12B are views showing the short return operation of returning the plate 400 from the closed position to an initially-set position. When the drive motor rotates counterclockwise, the intermediate gear 600 rotates clockwise, and the segment gear 500 meshed with the intermediate gear rotates counterclockwise, i.e. in the same direction as the drive motor. In response to the counterclockwise rotation of the segment gear 500, the plate 400 provided on the shall 200 rotates counterclockwise to close the intake port 110 such that the outer circumference of the plate 400 comes into close contact with or approaches very close to the inner wall of the intake port 110.

Here, the direction in which the plate 400 is perpendicular to the direction of an air flow within the intake port 110, i.e. the state in which the plate 400 is in a position corresponding to the cross-section of the intake port 110, is referred to as the closed position. In this closed position, the first coil spring 810 is elastically deformed in the unwinding direction. However, since the level of deformation is insignificant, the first coil spring continues to apply counterclockwise torque to the segment gear 500.

In addition, the segment gear 500 rotates counterclockwise as much as the other end portion 820*b* of the second coil spring 820 moves in the direction toward one side within the third fixing recess 550 (i.e. in the direction toward the gear portion disposed on the flange portion) in the state in which the other end portion 820*b* of the second coil spring 820 is held by the lug portion 130. Since the other end portion 820*b* of the second coil spring 820 comes into completely close contact with one side of the third fixing recess 550, the counterclockwise rotation of the segment gear 500 is limited, whereby the plate 400 is deployed to the closed position.

Accordingly, the second coil spring 820 is elastically deformed such that is further wound, thereby increasing the restoring force. That is, the angle of rotation of the segment gear 500 when the plate 400 rotates from the initially-set position to the closed position corresponds to the width A of the third fixing recess 550 that extends from one side to the other side.

Therefore, the restoring force of the second coil spring 820, which is greater than that of the first coil spring 810 that applies counterclockwise torque to the segment gear 500, is further increased, whereby the segment gear 500 is subjected to clockwise torque from the second coil spring 820.

In this state, when the supply of power to the drive motor is shut off and thus the external force that has been acting on the segment gear 500 is removed, the segment gear 500 is rotated clockwise by the restoring force of the second coil spring 820 that exceeds the counterclockwise torque of the first coil spring 810 acting on the segment gear 500. Here, the angle at which the segment gear 500 rotates clockwise corresponds to the width A of the third fixing recess 550.

In this manner, the segment gear 500 is rotated clockwise from the closed position by the second coil spring 820, and thus the plate 400 returns to the initially-set position in which it is partially rotated within the intake port 110, whereby the short return operation is completed.

Figure 13:
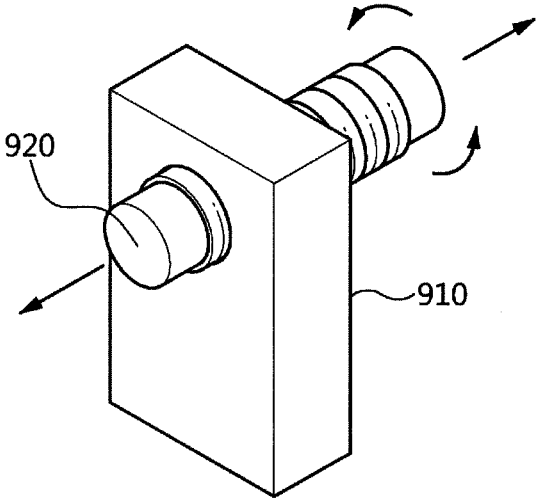
FIG. 13 is a view showing a limiting means according to an embodiment of the present invention.

FIG. 13 is a view showing a limiting means 900 according to an embodiment of the present invention. The limiting means 900 protrudes from one side surface of the body 100 such that it is close to the circumference of the segment gear 500, thereby limiting the angle of rotation of the segment gear 500.

The limiting means 900 includes a support 910 which protrudes from one side surface of the body 100 and a stopper 920 which is disposed on the upper portion of the support 910 such that it can be supported on one end portion of the gear portion 520 which is disposed on the circumference of the flange portion 510.

The stopper 920 prevents the plate 400 from being deployed to the closed position. When the plate 400 is deployed to the closed position, the outer circumference of the plate 400 may be damaged through friction against the inner surface of the intake port 110. The angle of rotation of the segment gear 500 can be limited by the stopper 920 such that the plate 400 is not completely deployed to the closed position, thereby preventing the endurance of the plate 400 from degrading.

The stopper 920 penetrates through the upper portion of the support 910, and is provided with threads on the outer circumference thereof with which the maximum angle of rotation of the segment gear 500 in the counterclockwise direction can be adjusted. That is, when the stopper 920 is rotated in the forward or reverse direction depending on the condition or design of a vehicle, the stopper 920 moves forwards or backwards on the upper portion of the support 910 with respect to the segment gear 500.

As set forth above, the use of the valve assembly 1 according to the present invention has an advantage in that the plate 400, which controls the open ratio of the intake port 110, can be rapidly returned to the initially-set position from the open or closed position.

In addition, it is possible to return the plate 400 to the initially-set position using the simple configuration of the segment gear 500. There are effects in that the number of parts can be reduced and the volume of the valve assembly 1 can be minimized.

Furthermore, the valve assembly 1 according to the present invention can mechanically restore the valve open position when the supply of electric power is shut off. The valve assembly 1 is therefore especially available for application to an electronic throttle valve and can improve the safety of a vehicle. That is, since the limit of rotation of the segment gear 500 is mechanically determined using, for example, the returning means and the limiting means 900, there is an effect in that the throttle valve can be prevented from malfunctioning due to the failure of a power supply.

Although the preferred embodiments of the present invention have been disclosed for illustrative purposes, the principle of the invention is not limited to the accompanying drawings and the foregoing disclosure. A skilled in the art will appreciate that various modifications, additions and substitutions are possible, without departing from the spirit of the invention as disclosed in the accompanying claims. It is to be understood that such modifications fall within the scope of the invention defined by the claims as long as they do not depart from the idea of the invention.

What is claimed is:

1. A valve assembly which controls an open ratio of a throttle valve using a drive motor operated by an engine control unit depending on an open ratio of an accelerator pedal, the valve assembly comprising:

a throttle body which has defined therein an intake port which penetrates through the throttle body from a front end to a rear end;

a shaft disposed in the throttle body, the shaft penetrating through the throttle body from one side surface to the opposite side surface;

bearings disposed on each of end portions of the shaft;

a plate disposed on a central portion of the shaft to open or close the intake port in response to a rotation of the shaft;

a segment gear disposed on one side of the throttle body and coupled to one end portion of the shaft;

an intermediate gear which transmits driving force of a drive motor provided on the throttle body to the segment gear;

a cover which closes the intermediate gear from the outside; and a returning means including a pair of elastic members which are provided on the segment gear, wherein, when the driving force from the drive motor that has been acting on the intermediate gear is shut off, the segment gear is rotated by a different one of the pair of elastic members according to whether the plate is deployed to an open or closed position, thereby returning the plate to an initially-set position, wherein the segment gear comprises:

a flange portion disposed on an upper portion of the segment gear, with a gear portion being formed on part of a circumference of the flange portion;

a first fixing recess defined by a sunken portion in the circumference of the flange portion;

a tubular outer case extending downward from the flange portion;

a tubular inner case extending downward from the flange portion, the inner case being spaced apart from an inner side surface of the outer case to form a receptacle, and an inner diameter of the inner case being smaller than that of the outer case;

a second fixing recess extending upward from a lower end of the outer case, the second fixing recess opening part of a side surface portion of the outer case; and a third fixing recess extending upward from a lower end of the outer case that opposes the second fixing recess, the third fixing recess opening part of the side surface portion of the outer case.

2. The valve assembly according to claim 1, wherein the first fixing recess is formed close to one of either end portions of the gear portion disposed on the circumference of the flange portion.

3. The valve assembly according to claim 1, wherein the gear portion disposed on the flange portion is positioned between the second and third fixing recesses.

4. The valve assembly according to claim 1, wherein a separation-preventing recess is further provided on an upper or lower portion of the second fixing recess, the separation-preventing recess extending in a direction parallel to a direction in which the segment gear rotates.

5. The valve assembly according to claim 4, wherein the separation-preventing recess extends from an upper or lower portion of the second fixing recess in a direction opposite to the gear portion disposed on the flange portion.

6. The valve assembly according to claim 1, wherein the second fixing recess is positioned below the first fixing recess.

7. The valve assembly according to claim 1, wherein the returning means includes:

a first coil spring disposed such that the first coil spring surrounds an outer circumference of the outer case, one end portion of the first coil spring being fixed to the first fixing recess, and the other end portion of the first coil spring being fixed to a fixing slot which is formed on one side surface of the throttle body; and a second coil spring disposed in the receptacle defined between the outer case and the inner case, one end portion of the second coil spring being fixed to the second fixing recess, and the other end portion of the second coil spring being fixed to the third fixing recess.

8. The valve assembly according to claim 7, wherein an inner surface of the first coil spring is spaced apart from an outer circumference of the outer case, thereby defining a space portion.

9. The valve assembly according to claim 7, wherein, when the plate is in the open position, the plate is returned to the initially-set position by elastic restoring force of the first coil spring, and when the plate is in the closed position, the plate is returned to the initially-set position by elastic restoring force of the second coil spring.

10. The valve assembly according to claim 7, the other end portion of the first coil spring is disposed at a position ranging from 90 to 110° in a clockwise direction with respect to a bottom of a vertical line that passes through one end portion of the first coil spring, the other end portion of the first coil spring being bent outward from the first coil spring.

11. The valve assembly according to claim 7, wherein one end portion of the second coil spring is bent to extend outward from the second coil spring, and the other end portion of the second coil spring is formed at a position ranging from 360 to 450° in a clockwise direction with respect to one end portion of the second coil spring and is bent to extend outward from the second coil spring.

12. The valve assembly according to claim 7, wherein one end portion of the second coil spring is fixed to the second fixing recess, and the other end portion of the second coil spring is fixed to the third fixed recess by being turned counterclockwise such that the second coil spring is elastically deformed in a winding direction.

13. The valve assembly according to claim 5, wherein one end of a second coil spring is disposed in the separation-preventing recess which is formed in the upper or lower portion of the second fixing recess.

14. The valve assembly according to claim 7, wherein a lug portion is provided on a portion of one side surface of the throttle body to which the segment gear is coupled, the lug portion protruding from one side surface of the throttle body at a position ranging from 180 to 270° in a clockwise direction from the fixing slot with respect to one end portion of the shaft which protrudes toward one side surface of the throttle body.

15. The valve assembly according to claim 14, wherein the segment gear is rotated clockwise such that the first coil spring is elastically deformed in a winding direction after the other end portion of the first coil spring is fixed to the fixing slot, such that the other end portion of the second coil spring is fixedly held by the lug portion.

16. The valve assembly according to claim 15, wherein the second coil spring is fixedly held by the lug portion such that the other end portion of the second coil spring is positioned between the fixing slot and the lug portion.

17. The valve assembly according to claim 14, wherein the first coil spring applies a torque that causes the segment gear to rotate counterclockwise when the plate is in the open or closed position, and wherein the second coil spring is separated from the lug portion without applying an elasticity-induced torque to the segment gear when the plate is in the open position, and is held by the lug portion and applies a torque that causes the segment gear to rotate clockwise when the plate is in the closed position.

18. The valve assembly according to claim 7, wherein elastic force of the second coil spring is greater than elastic force of the first coil spring.

19. The valve assembly according to claim 1, the valve assembly comprising an electronic throttle valve.

* * * * *